United States Patent [19]

Liebermann et al.

[11] Patent Number: 5,043,029

[45] Date of Patent: Aug. 27, 1991

[54] CASTING IN A EXOTHERMIC REDUCTION ATMOSPHERE

[75] Inventors: Howard H. Liebermann, Succasunna; John A. Wellslager, Mount Arlington; Lance A. Davis, Morristown, all of N.J.

[73] Assignee: Allied-Signal Inc., Morris Township, Morris County, N.J.

[21] Appl. No.: 627,871

[22] Filed: Dec. 13, 1990

Related U.S. Application Data

[60] Continuation of Ser. No. 6,359, Jan. 8, 1987, abandoned, which is a division of Ser. No. 898,828, Aug. 20, 1986, abandoned, which is a continuation of Ser. No. 490,922, May 2, 1983, abandoned, which is a continuation of Ser. No. 483,473, Apr. 11, 1983, abandoned.

[51] Int. Cl.[5] ..... B21C 37/00

[52] U.S. Cl. ..... 148/403; 164/463

[58] Field of Search ..... 164/463, 423; 148/403; 428/606

[56] References Cited

U.S. PATENT DOCUMENTS

| | | | |
|---|---|---|---|
| 4,339,508 | 7/1982 | Tsuya et al. | 428/606 |
| 4,515,870 | 5/1985 | Bose et al. | 428/656 |
| 4,676,298 | 6/1987 | Liebermann | 164/463 |

FOREIGN PATENT DOCUMENTS

| | | | |
|---|---|---|---|
| 54-74698 | 6/1979 | Japan | 428/606 |

*Primary Examiner*—Kuang Y. Lin

*Attorney, Agent, or Firm*—Gus T. Hampilos

[57] ABSTRACT

An apparatus and method for casting metal strip include a moving chill body that has a quench surface. A nozzle mechanism deposits a stream of molten metal on a quenching region of the quench surface to form the strip. The nozzle mechanism has an exit portion with a nozzle orifice. A depletion mechanism supplies a reducing gas to a depletion region located adjacent to and upstream from the quenching region. The reducing gas reacts exothermically to lower the density provide a low density reducing atmosphere within the depletion and substantially prevent formation of gas pockets in the strip.

2 Claims, 5 Drawing Sheets

CASTING IN A EXOTHERMIC REDUCTION ATMOSPHERE

CROSS REFERENCE UNDER RELATED APPLICATIONS

This application is a continuation of application Ser. No. 006,359 filed Jan. 8, 1987 which is a divisional application of Ser. No. 898,828 filed Aug. 20, 1986, which is a continuation application Ser. No. 490,922 filed May 2, 1983, which in turn is a continuation-in-part of U.S. application Ser. No. 483,473 filed April 11, 1983, all now abandoned.

BACKGROUND OF THE INVENTION

1. Field of the Invention

The invention relates to the casting of metal strip directly from a melt, and more particularly to the rapid solidification of metal directly from a melt to form substantially continuous metal strip.

2. Description of the Prior Art

U.S. Pat. No. 4,142,571 issued to M. Narasimhan discloses a conventional apparatus and method for rapidly quenching a stream of molten metal to form continuous metal strip. The metal can be cast in an inert atmosphere or a partial vacuum. U.S. Pat. No. 3,862,658 issued to J. Bedell and U.S. Pat. No. 4,202,404 issued to C. Carlson disclose flexible belts employed to prolong contact of cast metal filament with a quench surface.

The casting of very smooth strip has been difficult with conventional devices because gas pockets entrapped between the quench surface and the molten metal during quenching form gas pocket defects. These defects, along with other factors, cause considerable roughness on the quench surface side as well as the opposite, free surface side of the cast strip. In some cases, the surface defects actually extend through the strip, forming perforations therein.

U.S. Pat. No. 4,154,283 to R. Ray et al. discloses that vacuum casting of metal strip reduces the formation of gas pocket defects. The vacuum casting system taught by Ray et al. requires specialized chambers and pumps to produce a low pressure casting atomosphere. In addition, auxiliary means are required to continuously transport the cast strip out of the vacuum chamber. Further, in such a vacuum casting system, the strip tends to weld excessively to the quench surface instead of breaking away as typically happens when casting in an ambient atmosphere.

U.S. Pat. No. 4,301,855 issued to H. Suzuki et al. discloses an apparatus for casting metal ribbon wherein the molten metal is poured from a heated nozzle onto the outer peripheral surface of a rotary roll. A cover encloses the roll surface upstream of the nozzle to provide a chamber, the atmosphere of which is evacuated by a vacuum pump. A heater in the cover heats the roll surface upstream from the nozzle to remove dew droplets and gases from the roll surface. The vacuum chamber lowers the density of the moving gas layer next to the casting roll surface, thereby decreasing formation of air pocket depressions in the cast ribbon. The heater helps drive off moisture and adhered gases from the roll surface to further decrease formation of air pocket depressions.

The apparatus disclosed by Suzuki et al. does not pour metal onto the casting surface until that surface has exited the vacuum chamber. By this procedure, complications involved in removing a rapidly advancing ribbon from the vacuum chamber are avoided. The ribbon is actually cast in the open atmosphere, offsetting any potential improvement in ribbon quality.

U.S. Pat. No. 3,861,450 to Mobley, et al. discloses a method and apparatus for making metal filament. A disk-like, heat-extracting member rotates to dip an edge surface thereof into a molten pool, and a non-oxidizing gas is introduced at a critical process region where the moving surface enters the melt. This non-oxidizing gas can be a reducing gas, the combustion of which in the atmosphere yields reducing or nonoxidizing combustion products at the critical process region. In a particular embodiment, a cover composed of carbon or graphite encloses a portion of the disk and reacts with the oxygen adjacent the cover to produce non-oxidizing carbon monoxide and carbon dioxide gases which can then surround the disk portion and the entry region of the melt.

The introduction of non-oxidizing gas, as taught by Mobley, et al., disrupts and replaces an adherent layer of oxidizing gas with the non-oxidizing gas. The controlled introduction of non-oxidizing gas also provides a barrier to prevent particulate solid materials on the melt surface from collecting at the critical process region where the rotating disk would drag the impurities into the melt to the point of initial filament solidification. Finally, the exclusion of oxidizing gas and floating contaminants from the critical region increases the stability of the filament release point from the rotating disk by decreasing the adhesion therebetween and promoting spontaneous release.

Mobley, et al., however, address only the problem of oxidation at the disk surface and in the melt. The flowing stream of non-oxidizing gas taught by Mobley, et al. is still drawn into the molten pool by the viscous drag of the rotating wheel and can separate the melt from the disk edge to momentarily disturb filament formation. The particular advantage provided by Mobley, et al., is that the non-oxidizing gas decreases the oxidation at the actual point of filament formation within the melt pool. Thus, Mobley, et al. fail to minimize the entrainment of gas that could separate and insulate the disk surface from the melt.

U.S. Pat. No. 4,282,921 and U.S. Pat. No. 4,262,734 issued to H. Liebermann disclose an apparatus and method in which coaxial gas jets are employed to reduce edge defects in rapidly quenched amorphous strips. U.S. Pat. No. 4,177,856 and U.S. Pat. No. 4,144,926 issued to H. Liebermann disclose a method and apparatus in which a Reynolds number parameter is controlled to reduce edge defects in rapidly quenched amorphous strip. Gas densities and thus Reynolds numbers, are regulated by the use of vacuum and by employing lower molecular weight gases.

Conventional methods, however, have been unable to adequately reduce surface defects in cast metal strip caused by the entrapment of gas pockets. Vacuum casting procedures have afforded some success, but when using vacuum casting, excessive welding of the cast strip to the quench surface and the difficultly of removing the cast strip from the vacuum chamber have resulted in lower yields and increased production costs. As a result, conventional methods have been unable to provide a commercially acceptable process that efficiently produces smooth strip with consistent quality and uniform cross-section.

SUMMARY OF THE INVENTION

The invention provides an apparatus and method for efficiently casting smooth metal strip and substantially preventing the formation of gas pocket defects therein. The apparatus of the invention includes a moving chill body having a quench surface, and includes a nozzle means for depositing a stream of molten metal on a quenching region of the quench surface to form the strip. The nozzle means has an exit portion with a nozzle orifice. A depletion means supplies a reducing gas to a depletion region located adjacent to and upstream from the quenching region. The reducing gas operates to create an exothermic reduction reaction that provides a low density reducing atmosphere within the depletion region and substantially prevents formation of gas pockets in the strip.

In accordance with the invention there is also provided a method for casting continuous metal strip. A chill body having a quench surface is moved at a selected speed, and a stream of molten metal is deposited on a quenching region of the quench surface to form the strip. Reducing gas is supplied to a depletion region located adjacent to and upstream from the quenching region. The reducing gas is reacted exothermically to lower the density thereof and to provide a low density reducing atmosphere within the depletion region.

The invention further provides a metal strip composed of metastable material having at least 50 percent glassy structure and a thickness of less than about 15 micrometers in the as-cast state.

The method and apparatus of the invention advantageously minimize the formation and entrapment of gas pockets against the quenched surface during the casting of the strip. As a result, the invention avoids the needs for complex vacuum casting apparatus and can be practiced in an ambient atmosphere. The exothermic reaction of the reducing gas in the depletion region surprisingly provides better and more uniform cooling and quenching of the molten metal. Heat resulting from the exothermically reacting gas provides a low density reducing atmosphere that inhibits the formation of gas pockets which operate to decrease contact between the molten metal and the quench surface. The more uniform quenching, in turn, provides improved physical properties in the cast strip. In particular, the reduction of surface defects on the quenched surface side of the strip increases the packing factor of the material and decreases localized stress concentrations that can cause premature mechanical failure. The smoothness of the free surface side of the cast strip (i.e. the side not in contact with the quench surface of the chill body) is also improved by the method and apparatus of the invention. This increased smoothness further increases the packing factor of the material. In production of amorphous metal strip, the more uniform quenching afforded by the low density reducing atmosphere provides a more consistent and uniform formation of the amorphous state. In manufacture of strip composed of magnetic material, the number and size of strip surface discontinuities is reduced, improving the magnetic properties of the strip.

Surface defects due to entrapped gas pockets are reduced, and there is much less chance for a gas pocket to perforate the strip. Surprisingly, very thin strips (less than about 15 micrometers in thickness) have been produced. These very thin strips are highly desirable in various applications. For example, in magnetic devices, such as inductors, reactors and high frequency electromagnetic devices, thin magnetic material substantially reduces power losses therein. In brazing, the use of thinner brazing foils substantially improves the strength of the brazed joints.

Moreover, the reduction of entrapped gas pockets markedly increases the heat conductive contact between the molten metal and the quench surface. Thicker strips of rapidly solidified metal can be produced. Such thicker strip is desireable because it can be more easily substituted for materials conventionally used in existing commercial applications. These thick strip components can, surprisingly, be provided by rapid solidification in a single quenching step in much less time with decreased cost.

Thus, the present invention effectively minimizes gas pocket defects on the strip surface which contacts the quench surface, and produces strip having a smooth surface finish and uniform physical properties. Complex equipment and procedures associated with vacuum casting are eliminated. The invention efficiently casts ultra thin as well as extra thick metal strip directly from the melt at lower cost and with higher yield. Such ultra thin and extra thick strips are especially suited for use in such applications as magnetic devices and can be substituted for conventional materials with greater effectiveness and economy.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF PREFERRED EMBODIMENTS

For the purposes of the present invention and as used in the specification and claims, a strip is a slender body the transverse dimensions of which are much smaller than its length. Thus, a strip includes wire, ribbon, sheet and the like of regular or irregular cross-section.

The invention is suitable for casting metal strip composed of crystalline or amorphous metal and is particularly suited for producing metal strip which is rapidly solidified and quenched at a rate of at least about $10^{4}$° C./sec from a melt of molten metal. Such rapidly solidified strip has improved physical properties, such as improved tensile strength, ductility and magnetic properties.

Figure 1:
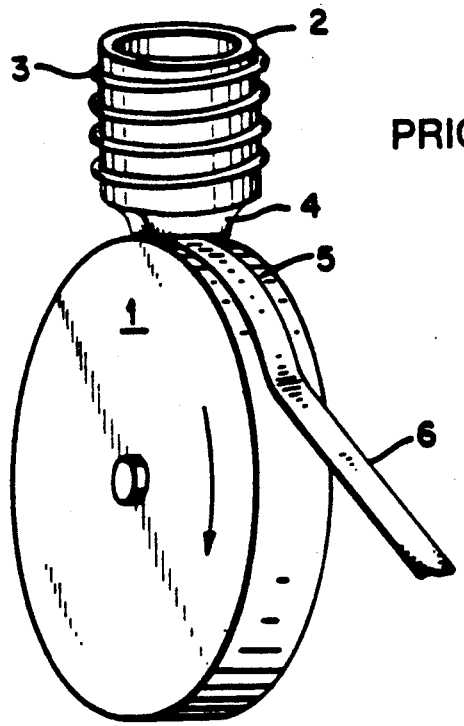
FIG. 1 shows a representative prior art apparatus for rapidly casting metal strip.

FIG. 1 shows a representative prior art device for rapidly casting continuous metal strip. Molten metal alloy contained in crucible 2 is heated by a heating element 3. Pressurization of the crucible with an inert gas forces a molten stream through a nozzle 4 at the base of the crucible and deposits the molten metal onto a moving chill body, such as rotatable casting wheel 1. Solidified moving strip 6, after its break-away point from the quench wheel is then routed onto a suitable winding means.

Quench surface 5 (substrate) is preferably a material having high thermal conductivity. Suitable materials include carbon steel, stainless steel and copper based alloys such as beryllium-copper. To achieve the quench rates of at least about $10^{4°}$ C. per second, wheel 1 is internally cooled and rotated to provide a quench surface that advances at a speed ranging from about 100–4000 meters per minute. Preferably, the quench surface speed ranges from about 200–3000 meters per minute. Typically, the thickness of the cast strip ranges from 25–100 microns (micrometers).

Figure 2:
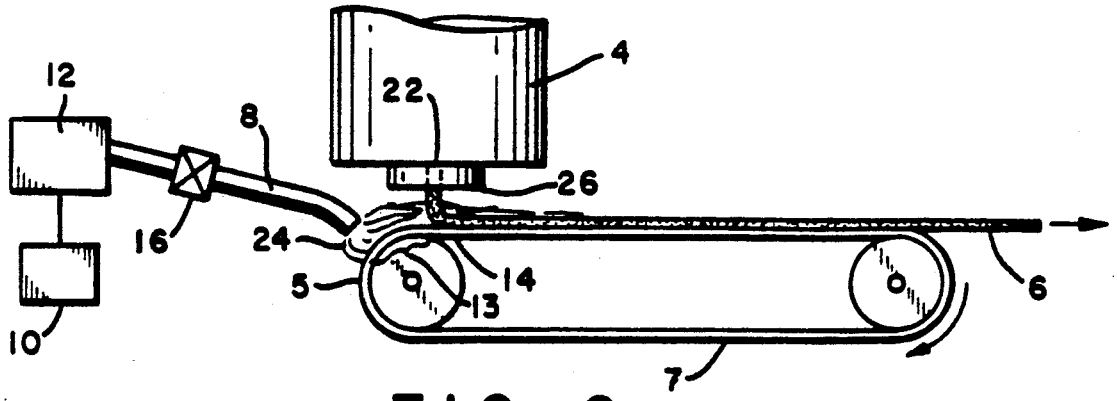
FIG. 2 shows a schematic representation of a embodiment of the invention which employs an endless casting belt.

FIG. 2 shows a representative apparatus of the invention. A moving chill body, such as endless casting belt 7, has a chilled casting quench surface 5. Nozzle means, such as nozzle 4, deposits a stream of molten metal onto a quenching region 14 of quench surface 5 to form strip 6. Nozzle 4 has an orifice 22 located at exit portion 26. A depletion means, including gas nozzle delivery means 8, and gas supply 12, supplies a reducing gas 24 from gas supply 12 to a depletion region 13 located adjacent to and upstream from quenching region 14.

Figure 3:
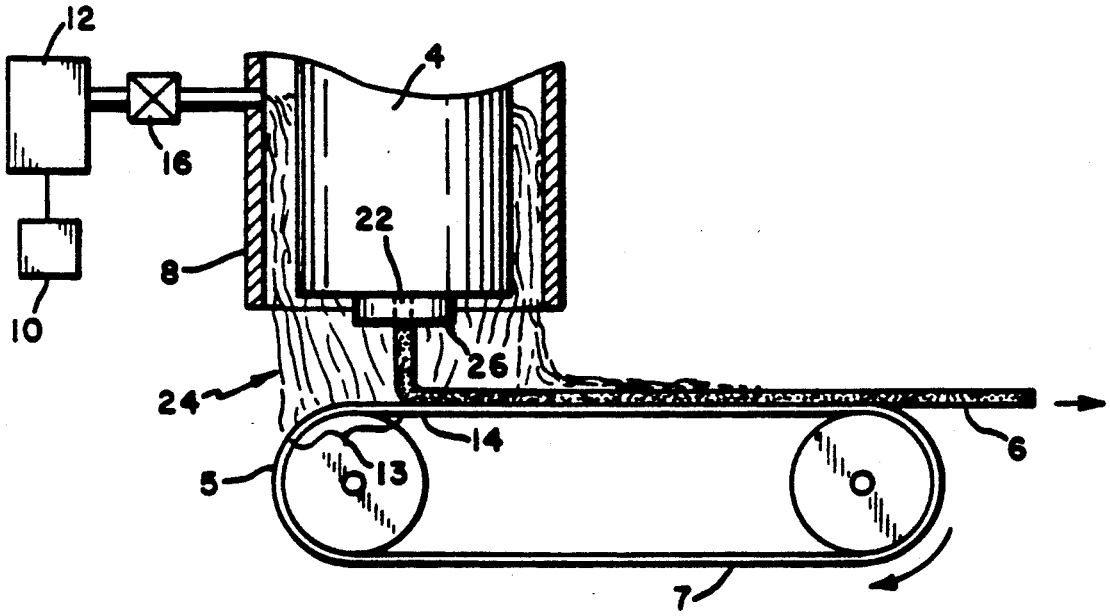
FIG. 3 shows an embodiment of the invention which employs a gas delivery means located coaxial with a casting nozzle.

The reducing gas reacts exothermically within the depletion region 13, providing a low density reducing atmosphere therewithin. Nozzle 8 is suitably located to direct reducing gas 24 at and around depletion region 13, so that the reducing gas 24 substantially floods the depletion region 13. Valve 16 regulates the volume and velocity through nozzle 8. As shown in FIG. 2, gas nozzle 8 is located upstream of quenching region 14 and is directed substantially normal to the direction of movement of the quench surface. Optionally, gas nozzle 8 can be located coaxial with casting nozzle 4 as representatively shown in FIG. 3.

The term low density reducing atmosphere, as used in the specification and claims hereof, means a reducing atmosphere having a gas density less than 1 gram per liter and preferably, having a gas density of of less than about 0.5 grams per liter.

To obtain the desired low density reducing atmosphere, gas 24 is exothermically reacted to at least about 800 K, and more preferably, is exothermically reacted to at least about 1300 K. In general, hotter reducing gases are preferred because they will have lower densities and will better minimize the formation and entrapment of gas pockets between quench surface 5 and the deposited molten metal.

Entrapped gas pockets are undesirable because they produce ribbon surface defects that degrade the surface smoothness. In extreme cases, the gas pockets will cause perforations through strip 6. A very smooth surface finish is particularly important when winding magnetic metal strip to form magnetic cores because surface defects reduce the packing factor of the material. The packing factor is the volume fraction of the actual magnetic material in the wound core (the volume of magnetic material divided by the total core volume) and is often expressed in percent. A smooth surface without defects is also important in optimizing the magnetic properties of strip 6 and in minimizing localized stress concentrations that would otherwise reduce the mechanical strength of the strip.

Gas pockets also insulate the deposited molten metal from quench surface 5 and reduce the quench rate in localized areas. The resultant, non-uniform quenching produces non-uniform physical properties in strip 6, such as non-uniform strength, ductility and magnetic properties.

For example, when casting amorphous metal strip, gas pockets can allow undesired crystallization in localized portions of the strip. The gas pockets and the local crystallizations produce discontinuities which inhibit mobility of magnetic domain walls, thereby degrading the magnetic properties of the material.

Thus, by reducing the entrapment of gas pockets, the invention produces high quality metal strip with improved surface finish and improved physical properties. For example, metal strip has been produced with packing factors of at least about 80%, and up to about 95%.

Figure 6:
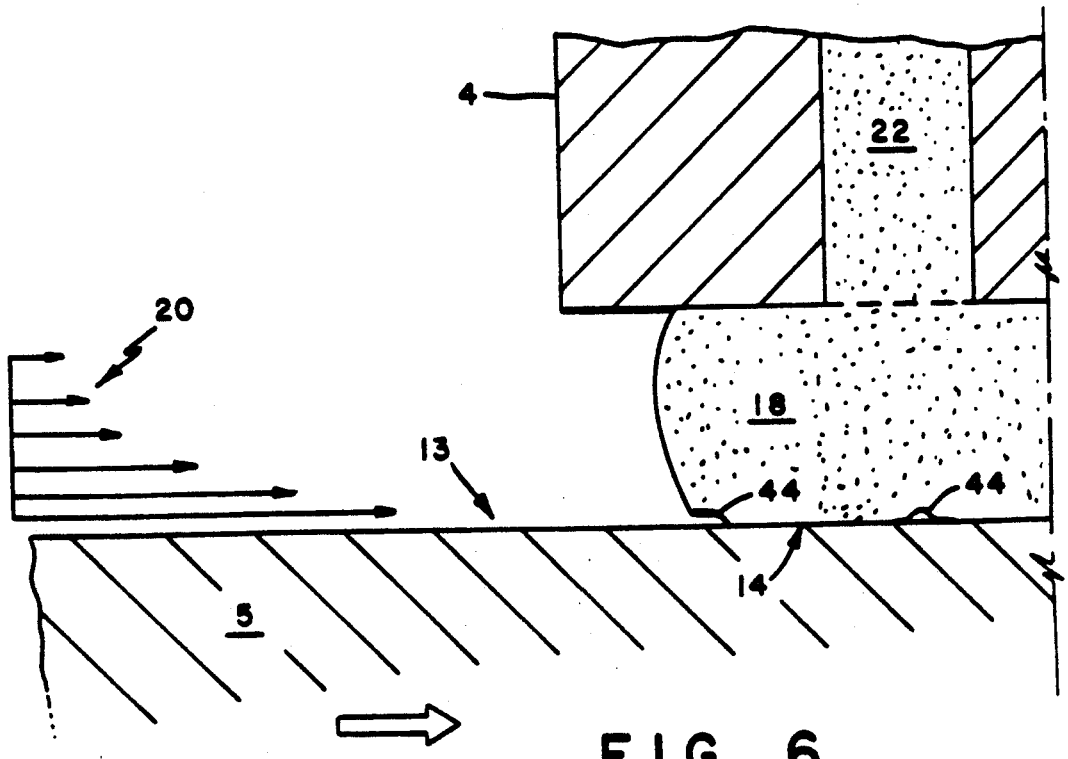
FIG. 6 shows a gas velocity profile at the quench surface portion on which molten metal is deposited.

The mechanism by which gas pockets are reduced can be more readily explained with reference to FIG. 6. The gas boundary layer velocity profile near quench surface 5 and upstream of melt puddle 18 is shown schematically at 20. The maximum gas boundary layer velocity occurs immediately adjacent to quench surface 5 (substrate) and is equal to the velocity of the moving quench surface Thus, moving quench surface 5 ordinarily draws cool air from the ambient atmosphere into depletion region 13 and into quenching region 14, the region of the quench surface upon which molten metal is deposited. Because of the drafting of relatively cool air into the quenching region, the presence of the hot casting nozzle and the molten metal do not sufficiently heat the local atmosphere to significantly reduce the density thereof Melt puddle 18 wets the substrate surface to an extent determined by various factors including the metal alloy composition, the substrate composition, and the presence of surface films. The pressure exerted by the gas boundary layer at the melt-substrate interface, however, acts to locally separate the melt from the substrate and form entrained gas pockets which will appear as "lift-off" areas 44 on the ribbon underside. The stagnation pressure of the gas boundary layer (pressure if the layer hit a rigid wall) is given by the formula $P_s = \frac{1}{2} \rho v^2$ where: $\rho$=gas density, v= substrate velocity. Therefore, the reduction of gas boundary layer density or substrate velocity are important in the reduction of the size and the number of gas pockets entrained under the molten metal puddle. For example, removal of the gas boundary layer by casting in vacuum can totally eliminate the lift-off areas in the strip underside. Alternatively, a low density gas in the boundary layer could be employed. The selection of a low molecular weight gas (such as helium) is one way to reduce boundary layer gas density. However, the variety of low molecular weight gases which can be safely and economically used in this fashion is quite limited. The invention provides an economical, safe means for reducing the boundary layer gas density. In accordance with the invention, the boundary layer gas density is reduced by exothermically reacting a reducing gas. As the exothermic reaction of the reducing gas proceeds, heat provided by the reaction causes the density of the gas to diminish as the inverse of the absolute temperature. By exothermically reacting a reducing gas in depletion region 13 at the upstream side of the melt puddle 18, the size and the number of entrained gas pockets under the melt puddle can be substantially reduced.

It is important, however, to regulate pertinent factors, such as the composition of the hot, low-density atmosphere, and the parameters of quench surface 5, to substantially prevent the formation of any solid or liquid matter which could precipitate onto quench surface 5. Such precipitate, if entrained between the melt puddle and quench surface, could produce surface defects and degrade the strip quality.

Surprisingly, heat produced by the low density reducing gas atmosphere located proximate to quenching region 14 does not degrade the quenching of the molten metal. Rather, heat produced by the reduction reaction actually improves the uniformity of the quench rate by minimizing the presence of insulating, entrapped gas pockets, and thereby improves the quality of the cast strip. Suitable reducing gases include carbon monoxide gas and gas mixtures therewith.

The presence of a reducing atmosphere at quench surface 5 has distinct advantages. In particular, a reducing atmosphere minimizes the oxidation of strip 6. In addition, the reducing atmosphere starves quench surface 5 of oxygen and minimizes the oxidation thereof. The reduced oxidation improves the wettability of the quench surface and allows molten metal to be more uniformly deposited on quench surface 5. In the case of a copper base materials in quench surface 5, the reduced oxidation renders the quench surface much more resistant to thermally induced fatigue crack nucleation and growth. The reducing atmosphere also depletes oxygen from the region of nozzle 4 thereby reducing the clogging of nozzle orifice 22, particularly clogging due to oxide particulates. Optionally, additional gas nozzle 32 may be employed to provide additional reducing gas atmospheres along selected portions of strip 6, as representatively shown in FIG. 4.

Figure 4:
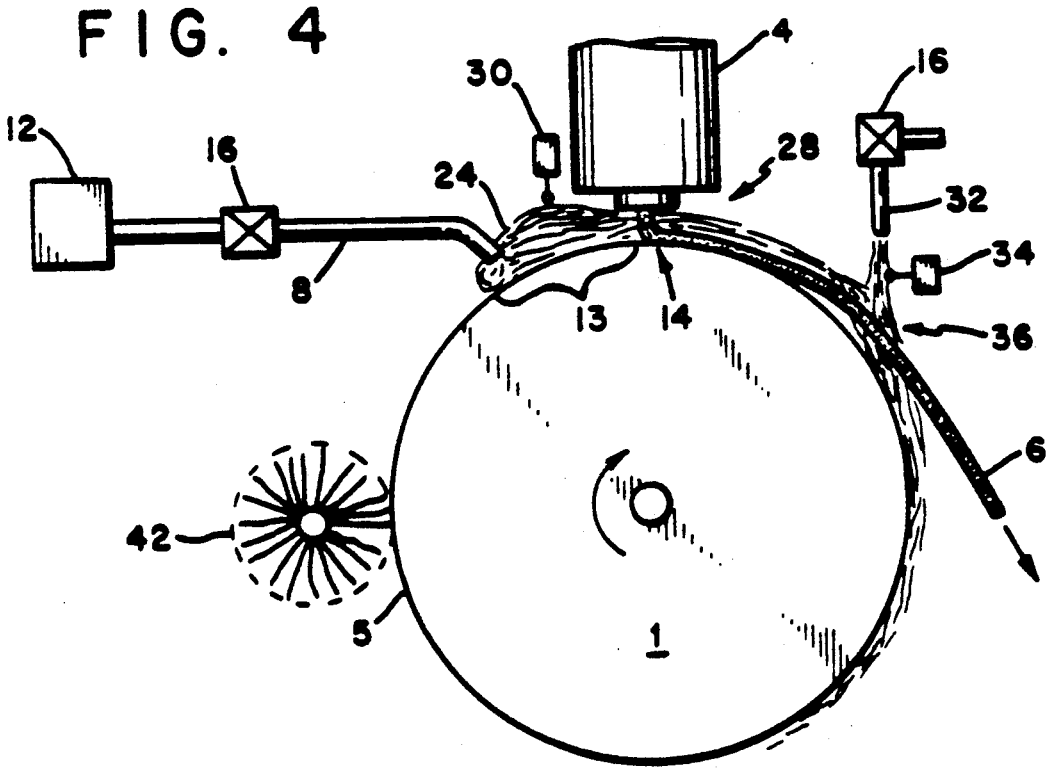
PRIOR ART FIG. 4
FIG. 4 shows an embodiment of the invention which employs a rotatable casting wheel.

FIG. 4 shows an embodiment of the invention wherein the reducing gas is capable of being ignited and burned to form a reducing flame atmosphere. Nozzle 4 deposits molten metal onto quench surface 5 of rotating casting wheel 1 to form strip 6. The depletion means in this embodiment is comprised of gas supply 12, gas nozzle 8 and ignition means 30. Valve 16 regulates the volume and velocity of gas delivered through gas nozzle 8, and a wiper brush 42 conditions quench surface 5 to help reduce oxidation thereon. After gas 24 has mixed with sufficient oxygen, ignition means 30 ignites the gas to produce a heated, low-density reducing atmosphere around depletion region 13 and around quench surface region 14 where molten metal is deposited. Suitable ignition means include spark ignition, hot filament, hot plates and the like. For example, in the embodiment shown in FIG. 4, the hot casting nozzle serves as a suitable ignition means which automatically ignites the reducing gas upon contact therewith.

The resultant flame atmosphere forms a flame plume 28 which begins upstream of quenching region 14 and consumes oxygen therefrom. In addition, unburned reducing gas within the plume reacts to reduce the oxides on quench surface 5, nozzle 4 and strip 6. The visibility of flame 28 allows easy optimization and control of the gas flow, and plume 28 is effectively drawn around the contour of wheel 1 by the wheel rotation to provide an extended reducing flame atmosphere. As a result, a hot reducing atmosphere is located around quenching surface 14 and for a discrete distant thereafter. The extended flame plume advantageously provides a non-oxidizing, protective atmosphere around strip 6 while it is cooling. Optionally, additional gas nozzles 32 and ignition means 34 can be employed to provide additional reducing flame plumes 36 along selected portions of strip 6 to further protect the strip from oxidation. A further advantage provided by the hot, reducing flame plume is that the smoothness of the free surface side of the strip (the side not in contact with the quench surface) is significantly improved. Experiments have shown that the mean roughness of the rapidly solidified metal strip, as measured by standard techniques such as pack factor, is significantly reduced when the strip is produced in the reducing flame plume of the invention.

Proper selection of the reducing gas is important. The combustion product of the burned gas should not produce a liquid or solid phase which could precipitate onto quench surface 5 or nozzle 4. For example, hydrogen gas has been unsatisfactory under ordinary conditions because the combustion product is water which condenses onto quench surface 5. As a result, the hydrogen flame plume does not adequately reduce the formation of gas pockets on the quench surface side of strip 6.

Therefore, the reducing gas 24 is preferably a gas that will not only burn and consume oxygen in a strongly exothermic reaction, but will also produce combustion products that will remain gaseous at casting conditions. Carbon monoxide (CO) gas is a preferred gas that satisfies the above criteria, and also provides a desireable, anhydrous, reducing atmosphere.

A reducing flame atmosphere provides an efficient means for heating the atmosphere located proximate to melt puddle 18 to very high temperatures, in the order of 1300–1500 K. Such temperatures provide very low gas densities around the melt puddle 18. The high temperatures also increase the kinetics of the reduction reaction to further minimize the oxidation of quench surface 5, nozzle 4 and strip 6. The presence of a hot reducing flame at nozzle 4 also reduces thermal gradients therein which might crack the nozzle.

Thus, the embodiment of the invention employing a reducing flame atmosphere more efficiently produces a heated, low-density reducing atmosphere around quench surface 5 which improves the smoothness of both sides of the cast strip and more effectively prevents oxidation of quench surface 5, strip 6 and casting nozzle 4.

Rapid quenching employing conditions described heretofore can be used to obtain a metastable, homogeneous, ductile material. The metastable material may be glassy, in which case there is no long range order. X-ray diffraction patterns of glassy metal alloys show only a diffuse halo, similar to that observed for inorganic oxide glasses. Such glassy alloys must be at least 50% glassy to be sufficiently ductile to permit subsequent handling, such as stamping complex shape from ribbons of the alloys. Preferably, the glassy metal alloys must be at least 80% glassy, and most preferably substantially (or totally) glassy, to attain superior ductility.

The metastable phase may also be a solid solution of the constituent elements. In the case of the alloys of the invention, such metastable, solid solution phases are not ordinarily produced under conventional processing techniques employed in the art of fabricating crystalline alloys. X-ray diffraction patterns of the solid solution alloys show the sharp diffraction peaks characteristic of crystalline alloys, with some broadening of the peaks due to desired fine-grained size of crystallites. Such metastable materials are also ductile when produced under the conditions described above.

The material of the invention is advantageously produced in foil (or ribbon) form, and may be used in product applications as cast, whether the material is glassy or a solid solution. Alternatively, foils of glassy metal alloys may be heat treated to obtain a crystalline phase, preferably fine-grained, in order to promote longer die life when stamping of complex shapes is contemplated.

Figure 5:
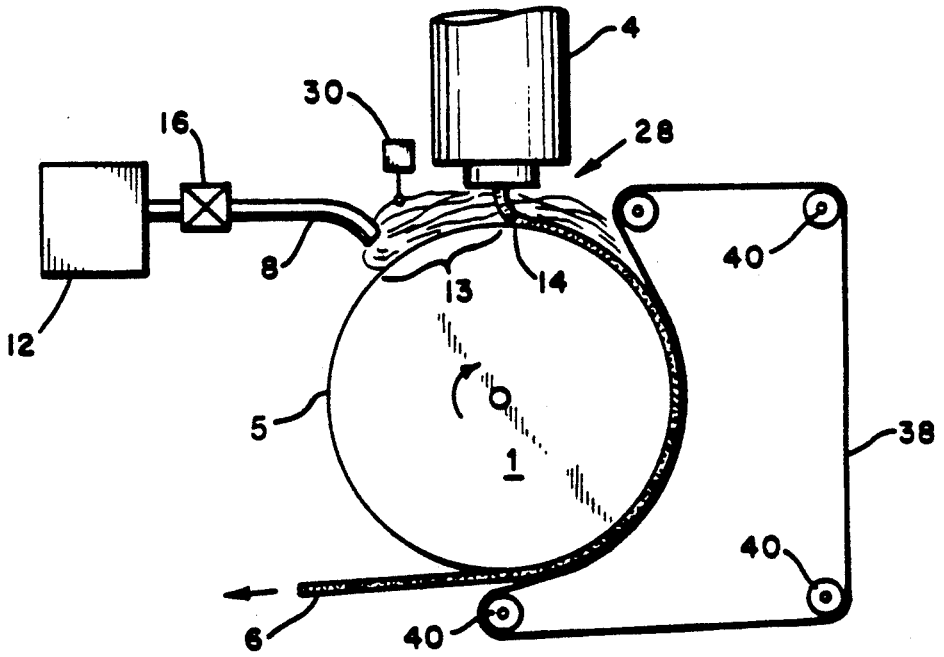
FIG. 5 shows an embodiment of the invention which employs a flexible hugger belt to prolong contact of the cast strip with the quench surface.

As shown in FIG. 5, the invention may optionally include a flexible hugger belt 38 which entrains strip 6 against quench surface 5 to prolong cooling contact therewith. The prolonged contact improves the quenching of strip 6 by providing a more uniform and prolonged cooling period for the strip. Guide wheels 40 position belt 38 in the desired hugging position along quench surface 5, and a drive means moves belt 38 such that the belt portion in hugging relation to quench surface 5 moves at a velocity substantially equal to the velocity of the quench surface. Preferably, belt 38 overlaps the marginal portions of strip 6 to directly contact and frictionally engage quench surface 5. This frictional engagement provides the required driving means to move the belt.

Considerable effort has been expended to develop devices and procedures for forming thicker strips of rapidly solidified metal because such strip can more easily be used as a direct substitute for materials presently employed in existing commercial applications. Since the present invention significantly improves the contact between the stream of molten metal and the chilled quench surface, there is improved heat transport away from the molten metal. The improved heat transport, in turn, provides a more uniform and more rapid solidification of the molten metal to produce a higher quality thick strip, i.e. strip having a thickness ranging from about 15 micrometers to as high as about 70 micrometers and more.

Similarly, considerable effort has been expended to form thinner strips of rapidly solidified metal. Very thin metal strip, less than about 15 microns and preferably about 8 microns in thickness, is highly desirable in various commercial applications. In brazing applications, for example, the filler metals used in brazed joint normaly have inferior mechanical properties compared to the base metals. To optimize the mechanical properties of a brazed assembly, the brazed joint is made very thin. Thus, when filler material in foil form is placed directly in the joint area prior to the brazing operation, the joint strength can be optimized by using a very thin brazing foil.

In magnetic applications with high frequency electronics (over 10 kHz), power losses in magnetic devices are proportional to the thickness (t) of the magnetic materials. In other magnetic applications such as saturable reactors, power losses are proportional to the thickness dimension of the magnetic material raised to the second power ($t^2$) when the material is saturated rapidly. Thus, thin ribbon decreases the power losses in the reactor. In addition, thin ribbon requires less time to saturate; as a result, shorter and sharper can be obtained from the reactor. Also, thin ribbons decrease the induced voltage per lamination and therefore, require less insulation between the laminations.

In inductors for linear induction accelerators, losses are again related to $t^2$, and the thinner ribbon will reduce power losses. Also, thin ribbon saturates more easily and rapidly and can be used to produce shorter pulse accelerators. In addition, the thinner ribbon will require reduced insulation between the laminations.

A further advantage of thin strip is that the strip experiences less bending stresses when wound to a given diameter. Excessive bending stresses will degrade the magnetic properties through the phenomenon of magnetostriction.

The apparatus and method of the invention are particularly useful for forming very thin metal strip. Since the invention significantly reduces the size and depth of gas pocket defects, there is less chance that such a defect will be large enough to perforate the cast strip. As a result, very thin strip can be cast because there is less probability that a defect large enough to perforate the strip will form. Thus, the invention can be adapted to cast very thin metal strip, which as-cast, is less than about 15 micrometers thick. Preferably, the cast strip has a thickness of 12 micrometers or less. More preferably, the cast strip thickness ranges from 7 to 12 micrometers. In addition, the thin metal strip has a width dimension which measures at least about 1.5 millimeters, and preferably measures at least about 10 mm.

EXAMPLE I

A forced-convection-cooled, casting wheel having a plain carbon steel substrate was used to prepare nickel-base and iron-base glassy metal ribbons. The casting wheel had an internal cooling structure similar to that described in U.S. Pat. No. 4,307,771, a diameter of 38 cm and a width of 5 cm. It was rotated at a speed of 890 rpm, corresponding to a circumferential surface velocity of 18 m/s. The substrate was conditioned continuously during the run by a conditioning brush wheel inclined about 10° out of the casting direction. A nozzle having a slotted orifice of 0.4 millimeter width and 25 millimeter length defined by a first lip and a second lip each having a width of 1.5 millimeters (lips numbered in direction of rotation of the chill roll) was mounted perpendicular to the direction of movement of the peripheral surface of the casting wheel, such that the each of second lip and the gap between the first lip and the surface of the casting wheel was 0.20 millimeter. Nickel-base metal alloy having composition $Ni_{68}Cr_7Fe_3B_{1.4}Si_8$ (subscripts in atomic percent) with a melting point of about 1000° C. was supplied to the nozzle from a pressurized crucible, the metal within the crucible being maintained under pressure of about 3.5 psig (24 kPa) at temperature of 1300° C. Pressure was supplied by means of an argon blanket. The molten metal was expelled through the slotted orifice at the rate of 6.6 kilograms per minute. It solidified on the surface of the chill roll into a strip of 0.033 millimeter thickness having width of 2.54 cm. Upon examination using X-ray diffractometry, the strip was found to be amorphous in structure. The ribbon showed significant populations of entrapped air pockets in the underside. A dark oxidation track formed on the substrate surface during ribbon casting, limiting the ribbon substrate adhesion.

EXAMPLE II

The procedure of Example 1 was repeated, employing the equipment, process conditions, metal and alloys used in Example 1 except that a carbon monoxide flame was directed at the ribbon casting track upstream of the melt puddle to reduce oxidation and promote ribbon-substrate adhesion. The combined actions of the flame and the conditioning brush reduced the substrate oxidation, increased adhesion and produced ribbon having good geometric uniformity. The best results were obtained when the distance between the carbon monoxide flame and the back of the melt puddle was less than about 2 cm (<1 inch). Tensile specimens cut from the strip in longitudinal and transverse direction exhibited equal tensile strength and elongation. The strip had isotropic tensile properties.

EXAMPLE III

The procedure of Example 1 was repeated, employing the equipment, process conditions metal and alloy summarized in the Table I below to obtain the product described therein.

TABLE I

| | |
|---|---|
| Alloy (At. %) | $Fe_{81}B_{13.5}C_2Si_{3.5}$ |
| Casting wheel diameter (cm) | 38 |
| Casting wheel width (cm) | 5 |
| Casting wheel rpm | 890 |
| Nozzle orifice width (mm) | 2.5 |
| Nozzle orifice length (mm) | 0.4 |
| Width first lip (mm) | 1.5 |
| Width second lip (mm) | 1.5 |
| Gap-second lip to casting wheel (mm) | 0.20 |
| Gap-first lip to casting wheel (mm) | 0.20 |
| Melting point of metal (°C.) | 1150 |
| Pressure applied to crucible (kPa) | 24 |
| Temp. of metal in crucible approx. (°C.) | 1350 |
| Thickness of strip (mm) | .02 |
| Width of strip (mm) | 25 |
| Structure of strip | Amorphous |

The iron base ribbon was annealed in an inert gas atmosphere for 2 hours at a temperature of 365° C. in a field of 80 amperes/meter applied longitudinal of the ribbon length.

Figure 7A:
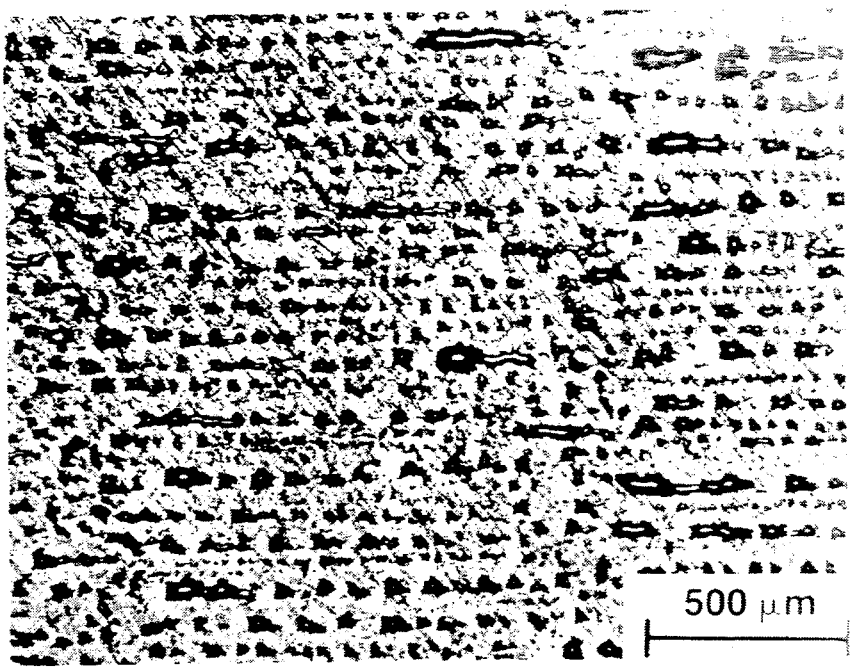
FIGS. 7 A–B show photographs of the quench surface side of strip cast in air on a beryllium copper substrate.
Figure 7B:
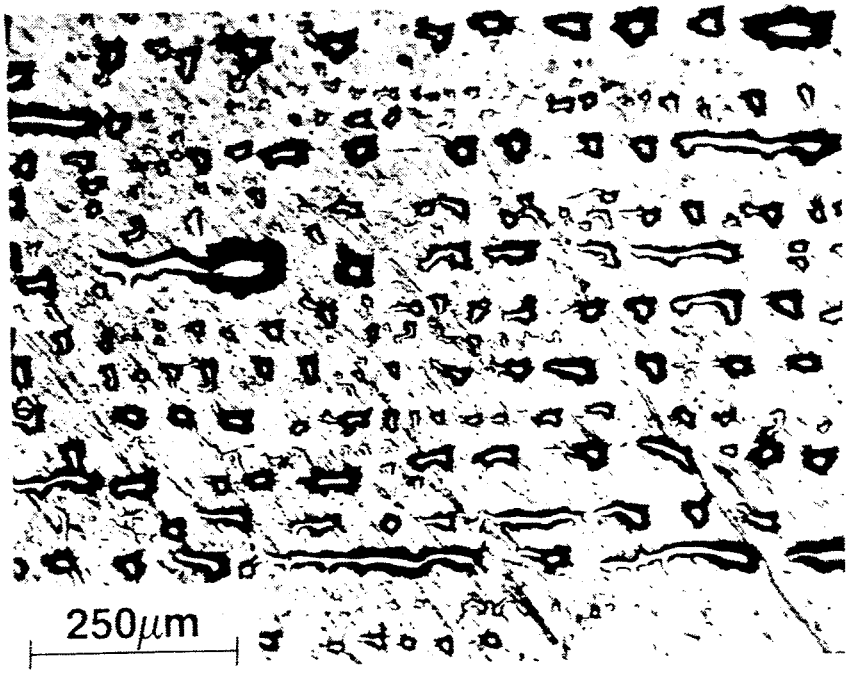

A photomicrograph showing the underside of the iron-base, amorphous ribbon is depicted in FIGS. 7A–B. Note that the included air pockets shown are rather large and elongated.

EXAMPLE IV

Figure 8A:
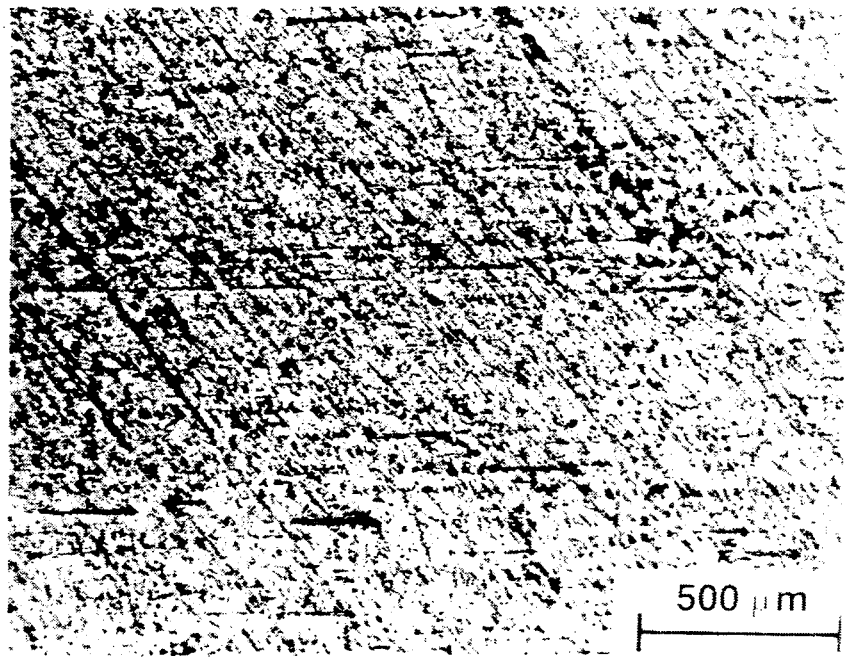
FIGS. 8 A–B show photographs of the quench surface side of a strip cast in a carbon monoxide reducing flame on a beryllium copper substrate.
Figure 8B:
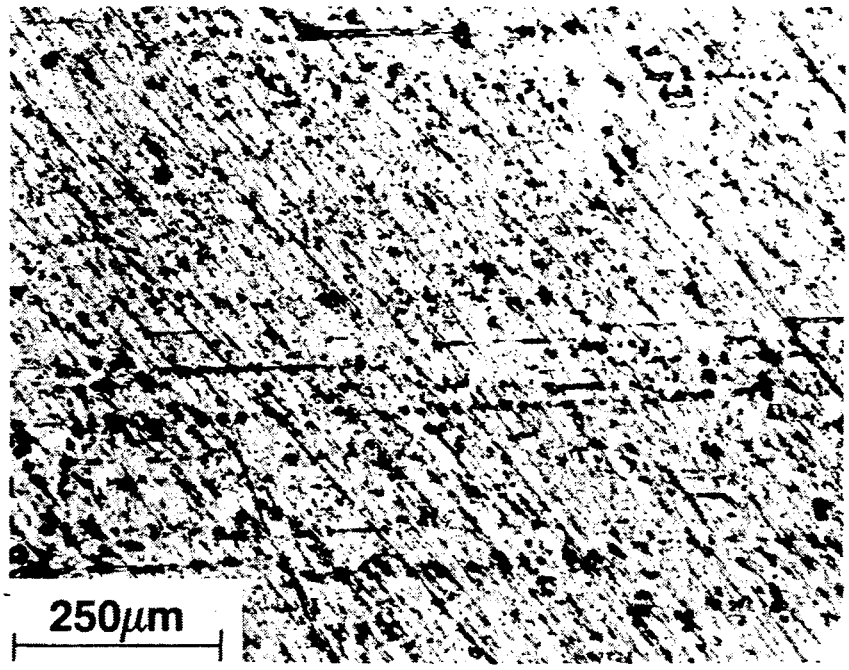

The procedure of Example 3 was repeated employing the same equipment, process conditions and alloy except that a carbon monoxide flame was directed at the ribbon casting track upstream of the melt puddle to reduce oxidation and promote ribbon substrate adhesion. A photomicrograph showing the underside of the iron-base amorphous ribbon produced using the carbon monoxide flame is depicted in FIGS. 8 A–B. Note the significant reduction in included air pockets on the underside of iron-base ribbon cast using the carbon monoxide flame as compared with those shown in FIGS. 7A–B. Magnetic properties of the ferromagnetic ribbons as well as the pack factor thereof were also improved (see Table II below). Similar improvements in the underside of nickel-base amorphous ribbon have also been observed.

Thus, experiments have shown remarkable improvement of ribbon surface smoothness, luster, and ductility over material cast in a conventional manner. While the intrinsic wetting of a copper substrate by ferrous melts may not be as great as the wetting of an iron-based substrate, the use of a carbon monoxide flame enhances melt-copper substrate wetting to the point where a copper substrate is a viable material for the production of high quality, defect-free strip. Such a defect-free casting capability allows the production of very thin ribbon (on the order of about 7 micrometers thick). Additionally, the improved melt-substrate contact caused by carbon monoxide flame-assisted casting improves overall quench rate and enables the production of a given ribbon composition at a thickness greater than usual.

Experimental results are summarized in Table II below:

TABLE II

| SAMPLE | ATMOSPHERE | AVERAGE RIBBON THICKNESS, μm | PACKING FACTOR, % | MAGNETIZATION LOOP SQUARENESS $B_r/B_1$ AS-CAST | ANNEALED |
|---|---|---|---|---|---|
| 1 | Air | 18.0 | 77 | 0.66 | 0.97 |
| 2 | CO flame | 14.9 | 93 | 0.95 | 0.99 |
| 3 | CO flame | 19.8 | 90 | 0.91 | 0.99 |
| 4 | CO flame | 30.2 | 90 | 0.86 | 0.96 |
| 5 | $H_2$ flame | 14.2 | 67 | 0.49 | 0.86 |

Table I illustrates the advantages of the present invention. The ribbon cast in air (sample 1) was made by the casting procedure taught in U.S. Pat. No. 4,142,571 to Narasimhan. Note the relatively low pack factor and magnetization loop squareness in both the ascast and annealed states. Ribbons of various thicknesses made using the teachings of the present invention (samples 2–4) have much improved pack factors and magnetization loop squareness in both the as-cast and annealed states. Sample 5 illustrates ribbon properties which result from casting in a flame atmosphere that produces nongaseous combustion products (water, in this case). The occurrence of poor melt wetting in the manufacture of sample 5 has resulted in the inferior properties measured.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A cast metal strip composed of an alloy which is at least about 50% amorphous, said strip having a thickness of about 12 micrometers or less, a width of at least about 10 millimeters and exhibiting a packing factor of at least about 80%.

2. The cast metal strip of claim 1, wherein the packing factor is at least about 90%.

* * * * *